US010039314B2

(12) United States Patent
Greene

(10) Patent No.: US 10,039,314 B2
(45) Date of Patent: Aug. 7, 2018

(54) CENTRIPETALLY ASSISTED PRE-FORMED CIGARETTE WRAPPER FILLER

(71) Applicant: David A Greene, Denver, CO (US)

(72) Inventor: David A Greene, Denver, CO (US)

( * ) Notice: Subject to any disclaimer, the term of this patent is extended or adjusted under 35 U.S.C. 154(b) by 407 days.

(21) Appl. No.: 14/877,447

(22) Filed: Oct. 7, 2015

(65) Prior Publication Data

US 2016/0095348 A1 Apr. 7, 2016

Related U.S. Application Data

(60) Provisional application No. 62/061,038, filed on Oct. 7, 2014.

(51) Int. Cl.
*A24C 5/02* (2006.01)
*A24C 5/40* (2006.01)

(52) U.S. Cl.
CPC . *A24C 5/02* (2013.01); *A24C 5/40* (2013.01)

(58) Field of Classification Search
CPC .... A24C 5/02; A24C 5/18; A24C 5/40; A24C 5/42
See application file for complete search history.

(56) References Cited

U.S. PATENT DOCUMENTS

| | | | |
|---|---|---|---|
| 2,425,888 A | 8/1947 | Matteson et al. | |
| 2,554,379 A | 5/1951 | Oetinger | |
| 2,629,386 A | 2/1953 | Kochalski | |
| 3,096,770 A | 7/1963 | Dearsley | |
| 3,578,778 A | 5/1971 | Matthews et al. | |
| 4,731,979 A | 3/1988 | Yamamoto et al. | |
| 5,615,692 A | 4/1997 | Ruppert et al. | |
| 2013/0181003 A1* | 7/2013 | Cieslikowski ..... | A24D 3/0216 221/1 |
| 2014/0182604 A1 | 7/2014 | Hutton et al. | |
| 2014/0202471 A1 | 7/2014 | Bao et al. | |

FOREIGN PATENT DOCUMENTS

| | | |
|---|---|---|
| EM | 2145688 A1 | 2/2010 |
| FR | 466301 A | 5/1914 |
| GB | 2124882 A | 2/1984 |
| WO | 02056714 A1 | 7/2002 |
| WO | 2007058811 A1 | 5/2007 |

OTHER PUBLICATIONS www.smokecones.com wrapping paper examples.

* cited by examiner

*Primary Examiner* — Eric Yaary
(74) *Attorney, Agent, or Firm* — Patent Law Offices of Rick Martin, P.C.

(57) ABSTRACT

A rotating platform has a peripheral wall to form a catch basin. A donut shaped wrapper housing can hold perhaps 50-100 cigarette wrappers facing inbound with a closed end projecting out an outer wall exit hole into the catch basin. Tobacco or any work material is dropped onto the center of the rotating platform which may be motor driven. Centripetal forces urge the work material into the wrappers. Empty wrapper channels feed the excess material into the catch basin. A lid prevents loss of work material.

11 Claims, 7 Drawing Sheets

CENTRIPETALLY ASSISTED PRE-FORMED CIGARETTE WRAPPER FILLER

CROSS REFERENCE APPLICATIONS

This application is a non-provisional application claiming the benefits of provisional application No. 62/061,038 filed Oct. 7, 2014.

BACKGROUND OF THE INVENTION

In past decades the publicity surrounding health concerns regarding the popular debate of the content of cigarettes and additive chemicals included therein has greatly increased. In the years following the continued and repeated publicity surrounding the motives and methods of large tobacco based industry and the content of their products has caused much question in the mind of consumers as to the product they use.

In addition to such publicity surrounding cigarette content, recent social popularity urges full disclosure and knowledge of other FDA overseen products such as food. A demographic of consumers chooses to purchase goods from distributors supporting a full disclosure and custom tailored business model for the consumer.

For years, individuals have rolled or filled their own pre-formed cigarette wrappers, generally with tobacco, but also often with other substances. Coupled with concern for content of cigarettes, personal customization of filler material and a variety of desired fillers not commercially available in cigarettes, the growing movement toward the filling of cigarette wrappers with custom filler materials has become a service provided by boutique or personalized services to accommodate the preferences of individual customers. The filler material in these cigarettes include but are not limited to tobacco, flavored tobacco, herbs and other combustible materials one may desire to smoke according to preference.

This business model is not exclusive of the cigarette and recreational smoking industry as it has grown to encompass a market segment of smokers who prefer a personalized fill for their cigarettes creating demand for such products and services. With this demand comes a need to enable the limited volume production of cigarettes tailored to individual or limited numbers of consumers. The typical business that provides such service is a small independently owned business with a limited customer base.

Large tobacco industries of course have solutions for manufacture of large quantities of cigarettes; however these solutions are not suitable of a limited run of 50 or 100 cigarettes for instance. These manufacturing solutions are designed to support the mass manufacture cigarettes at a rate of approximately 5.5 trillion per year, or 15 billion per day. Changeover for small run customization of such manufacturing machinery is neither cost effective nor sensible. Furthermore, such solutions are much too large and expensive for the boutique business owner or individual enthusiast utilizing such a machine for personal use.

The production of limited runs of customer tailored cigarette products require smaller more cost efficient apparatus designed for small run manufacturing of cigarettes regardless of if the manufacture of the cigarettes are by the final consumer or by a retail business.

The most efficient method of making custom cigarettes is currently with the use of pre-formed cigarette wrappers that exist in both conical and cylindrical forms. Some boutique businesses prefer the method of filling pre-formed tube-shaped cigarette wrappers as it simplifies the process, but filling such wrappers individually is time consuming and as a result the product manufacture cost is prohibitively high to the retailer to sell at a reasonable profit. As a result, such entities have adopted some apparatuses and methods to attempt a more efficient yet still customizable manufacturing approach to such products.

Some devices available in the prior art surrounding the art of filling pre-formed cigarette wrappers use a plunger-type mechanism. In such devices, the filler material such as tobacco is inserted to pack into the pre-formed tubular wrappers by means of a protrusion for the purposes of packing the filler material such as tobacco into the pre-formed cigarette wrapper tube from a large volume or reservoir of filler material. A problem with such solutions is that the plunger may catch on the wrapper tube and cause tears, creases, wrinkles in the form of the wrapper. Furthermore, many of these devices fill one pre-formed cigarette tube at a time making for a very time intensive manufacture of cigarettes.

Other devices in the prior art enable the sequential manufacture of cigarettes with a plunger-type mechanism. Such apparatus share in the problematic filling of wrapper tubes that can cause tears, creases and wrinkles in the wrapper. Furthermore, such machines do not ensure a consistent fill per wrapper tube so consistency from one cigarette to the next may not be as desired.

Other devices still, in the prior art, use a vibration or striking method which is either manually or mechanically driven to distribute filler material into pre-formed cigarette wrappers held in a vertical configuration in order to fill a plurality of pre-formed cigarette tube wrappers simultaneously followed by a symmetric multi-plunger unit to compact the fill from the top in a consistent manner. By using this process, the user ends up with a substantially homogeneous fill between cigarettes per batch. However, such apparatuses are limited in the number of pre-formed wrappers they may fill simultaneously. Thus, scaling such an apparatus to accommodate larger numbers produces an overtly cumbersome machine due to larger counterweighting needs to facilitate proper vibration dynamics.

The closest known prior art employs a horizontally planar apparatus comprising a spinning platform with circular recesses in a boundary housing to accept a plurality of pre-formed cigarette wrappers. As the platform spins, the user deposits the predetermined filler material onto the spinning platform in the dispensing area to be distributed centrifugally to each pre-formed wrapper. The problems existing with this machine are first the prior art lacks a catch basin. Expensive filler material is strewn around the room. Any filler material that is not captured within the pre-rolled cigarette wrappers may be ejected from the apparatus and wasted. Wasted filler material creates financial losses. If the material is ejected, it is undesirable to recapture potentially soiled filler material for eventual consumption when smoked. Furthermore, if the expectation of lost filler material exists, the manufacturer may have to account for ejected and wasted filler material and prepare a larger amount than necessary to fill the pre-formed cigarette wrappers. Thusly, any excess overage remaining after the manufacture further creates an additional avenue for waste.

Another problem with the known prior art are the recesses that constrain the wrappers during the operation of the unit. The recesses in the prior art are circular within a rectangular profile and resultantly provide substantial ineffective area on which filler material gets caught on rather than into a pre-formed wrapper. In the case of the vertically centered and tangentially oriented round recesses surrounding the entirety of the perimeter boundary, the amount of ineffective area is 21.4% while only 78.6% is effective area due to the inherent properties associated with a circular profile inscribed within a rectangular profile.

This problem forces a user to manually insert the remainder of the filler into individual cigarette wrappers or once again requiring the user to utilize an excess amount of filler material than that dictated by the amount needed to fill the pre-formed wrappers.

Further still, such prior art items operating as spinning platform unit are not capable of stopping outside of a 'spin-down' which is used herein to describe the natural decrease of rotational velocity predominantly due to friction or using a foreign object or hand to arrest the spinning motion. This creates a potentially dangerous situation and injurious situation to the user or those unaware of a unit left to spin-down unattended.

Finally the lid on the prior art does not lie flat on the boundary housing, thus filler material is wasted as it flows over the top of the boundary housing.

SUMMARY OF THE INVENTION

A device incorporating the embodiments of the invention is capable of providing the filling of a plurality of pre-formed cigarette wrappers or the like by means of a rotating platform disbursing a homogeneous fill of the selected filler material into said plurality of pre-formed wrappers substantially simultaneously using centripetal dynamic motion.

A unit, comprising of elements of a rotational planar platform, rectangular recesses enabling the constraint of bodies of a substantially cylindrical or conical form, a mechanism providing rotational motion to said platform, a containment device and brake mechanism.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 3A:
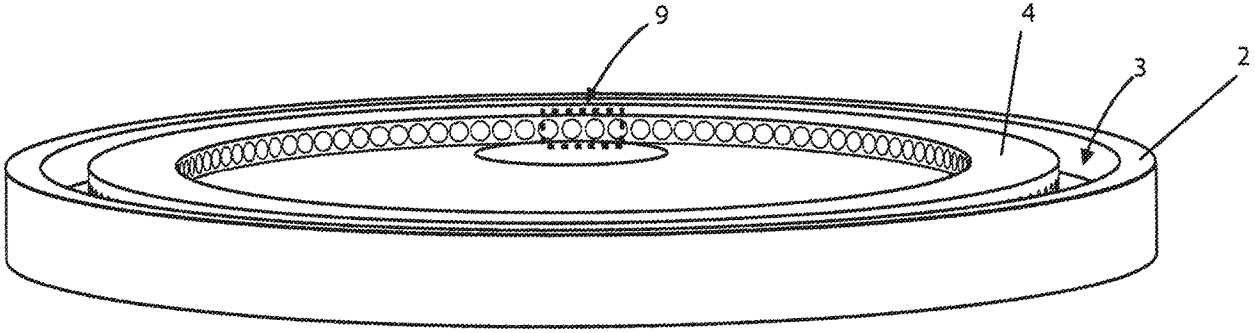
FIG. 3A is a tip perspective view of the rotatable platform.
Figure 3B:
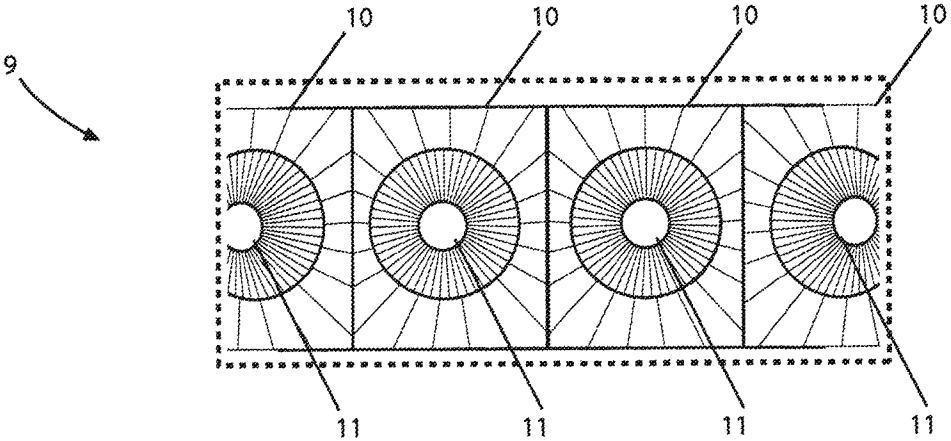
FIG. 3B is a close up front elevation view of four entry ports shown in FIG. 3A.

In an embodiment of the invention, the problem of packing a plurality of pre-rolled cigarette wrappers is solved by an apparatus 1 comprising a rotational platform with a rotational axis at its center of mass and a plurality of recesses. The rotational platform is constructed from a rigid or semi-rigid material that includes but is not limited to metal, polymer, wood and other organic or inorganic materials. The recesses 6 exist in a raised perimeter boundary offset from the center of the platform and are designed to hold a plurality of cylindrical or conical objects such as a pre-formed cigarette wrapper. Notably, in FIGS. 3A, 3B the transition of the exterior wall 9 to the exit port 11 features tapering from the rectangular aperture 10 to avoid accumulation of cigarette fill on the walls surrounding the recesses 6. In use, the pre-formed cigarette wrappers are inserted into the recesses 6 in preparation for filling. When the wrappers are inserted to enable the manufacture of the desired number of cigarettes, the user spins the platform manually, or optionally with assistive mechanism or electrically driven motor. When the platform has reached a predetermined speed, the user deposits the filler material substantially in the center of the rotating platform at which point the filler material is distributed to the perimeter boundary and into the pre-formed wrappers constrained by the recesses.

In a separate embodiment of the apparatus the rotational platform exhibits a planar designed to enable the complete and even distribution of filler material away from the center of the rotational platform of a substantially circular form. In one embodiment, the rotational platform utilizes a downward draft angle from the central rotational axis 8 providing a substantially conical shape. This contour may enable a complete and more homogeneous distribution of filler material away from the center than the alternative of a substantially planar rotational platform.

Furthermore, the preferred embodiment of the apparatus is comprised of a rotational platform of a substantially circular shape and recesses at a circumferential raised boundary with an external rectangular profile which transition to a conical or cylindrical form, thereby mitigating the problem associated with creating ineffective area and approaches a fully effective area for a more efficient production and need for excess filler material to make up for ineffective area.

In yet another embodiment of the invention, the apparatus comprising of a planar rotational platform with a substantially circular profile and circumferential raised boundary with a plurality of recesses 6, an electrically driven motor and integrated braking mechanism enabling the user to use the apparatus with higher, more consistent and more controllable speeds providing for a more consistent product and ability. As a result of the inherent higher speeds of operation (500-2000 rpm) associated with an electrically driven motor, the problem arises of stopping such a device in a controlled manner without risking the injury of the user. The integrated braking mechanism allows the user to stop the unit in an abbreviated period of time safely versus allowing for spin-down or utilizing a foreign object or hand to expedite the spin-down.

Such a braking device may exist in the form of electrical current control to provide active resistance, by means of frictional braking, magnetic resistance or any other method of braking appreciated by one skilled in the art. In one such embodiment of the apparatus, the braking mechanism exists as a magnetic braking mechanism with ferrous points embedded into a non-ferrous rotational platform. Upon introduction of a magnetic field to a rotating platform, the magnetic arrest braking mechanism enables the user slow and stop the rotating platform without physical interference.

In a separate embodiment of the apparatus, comprising further of a rotational platform and electrically driven motor, the aforementioned motor acts as the braking mechanism, utilizing electrical current variations to provide axial resistance via driving motor.

In another embodiment of the invention, the braking mechanism provides braking by method of applied friction. Such frictional braking may be applied to any moving part in the form of an axial brake to an axial shaft, single-sided friction to the rotational platform or preferably a caliper type pinching brake. In the one embodiment, the braking mechanism is comprised of a non-abrasive frictional brake applied to the rotational platform.

The problem surrounding the waste and loss of filler material when using a centripetally or vibration driven filling apparatus is solved by an embodiment of the invention comprising a planar rotational platform and a perimeter boundary 4 with integrated recesses 6 capable of holding pre-formed cigarette wrappers and a containment mechanism 3 (catch basin) to capture any filler material lost and otherwise potentially ejected from the apparatus during the filling process.

It will be appreciated by one skilled in the art that containment mechanisms or methods exist in passive or active strategies. As such a passive strategy typically provides a static boundary comprising typically of a rigid or semi-rigid material to provide a physical barrier. Similarly, it will be appreciated by one skilled in the art that active containment provides dynamic boundaries dictated by influences such as air pressure differentials, magnetic fields, electrostatic boundaries or moving bodies.

Figure 1B:
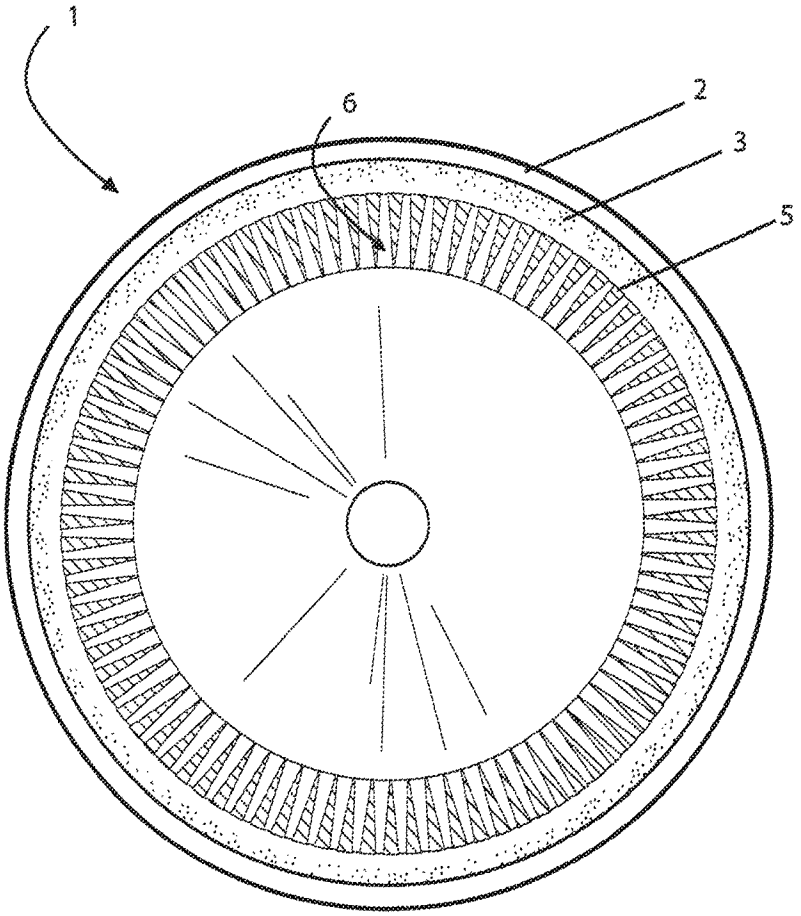
FIG. 1B is a top plan view of the rotatable platform without a cover.
Figure 1A:
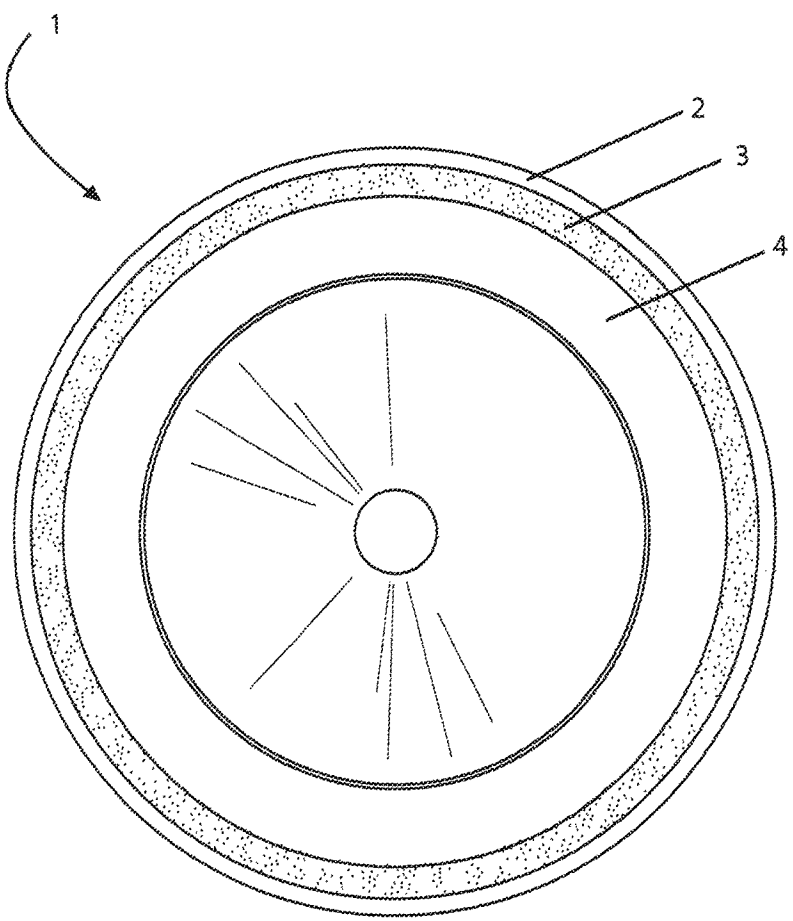
FIG. 1A is a top plan view of the rotatable platform with a cover.
Figure 2A:
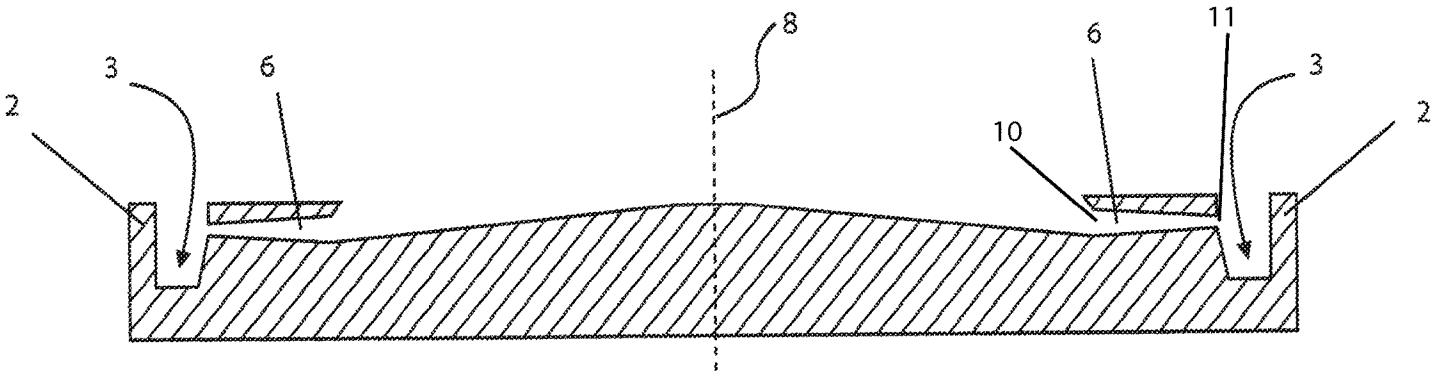
FIG. 2A is a cross sectional view of the rotatable platform shown in FIG. 2
Figure 2B:
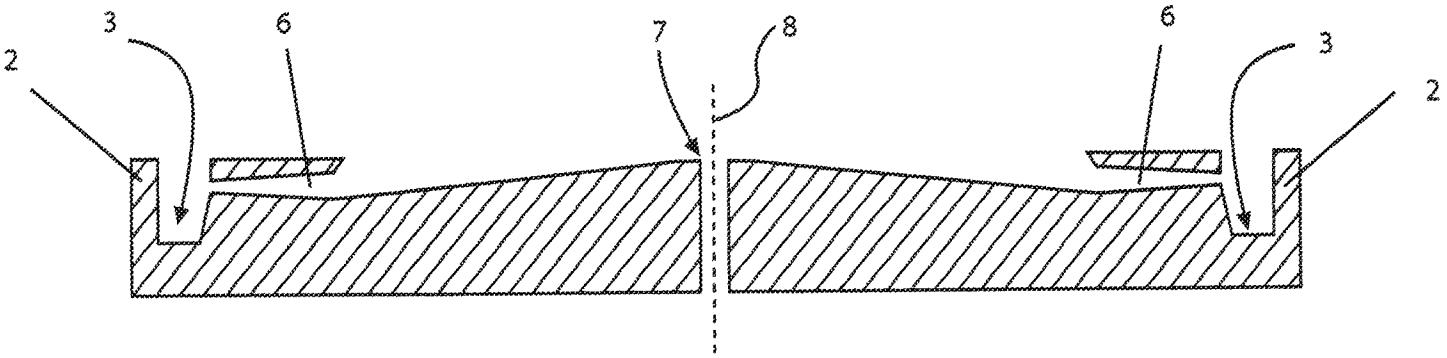
FIG. 2B is a cross sectional view of the rotatable platform with a central opening for an axle.
Figure 4:
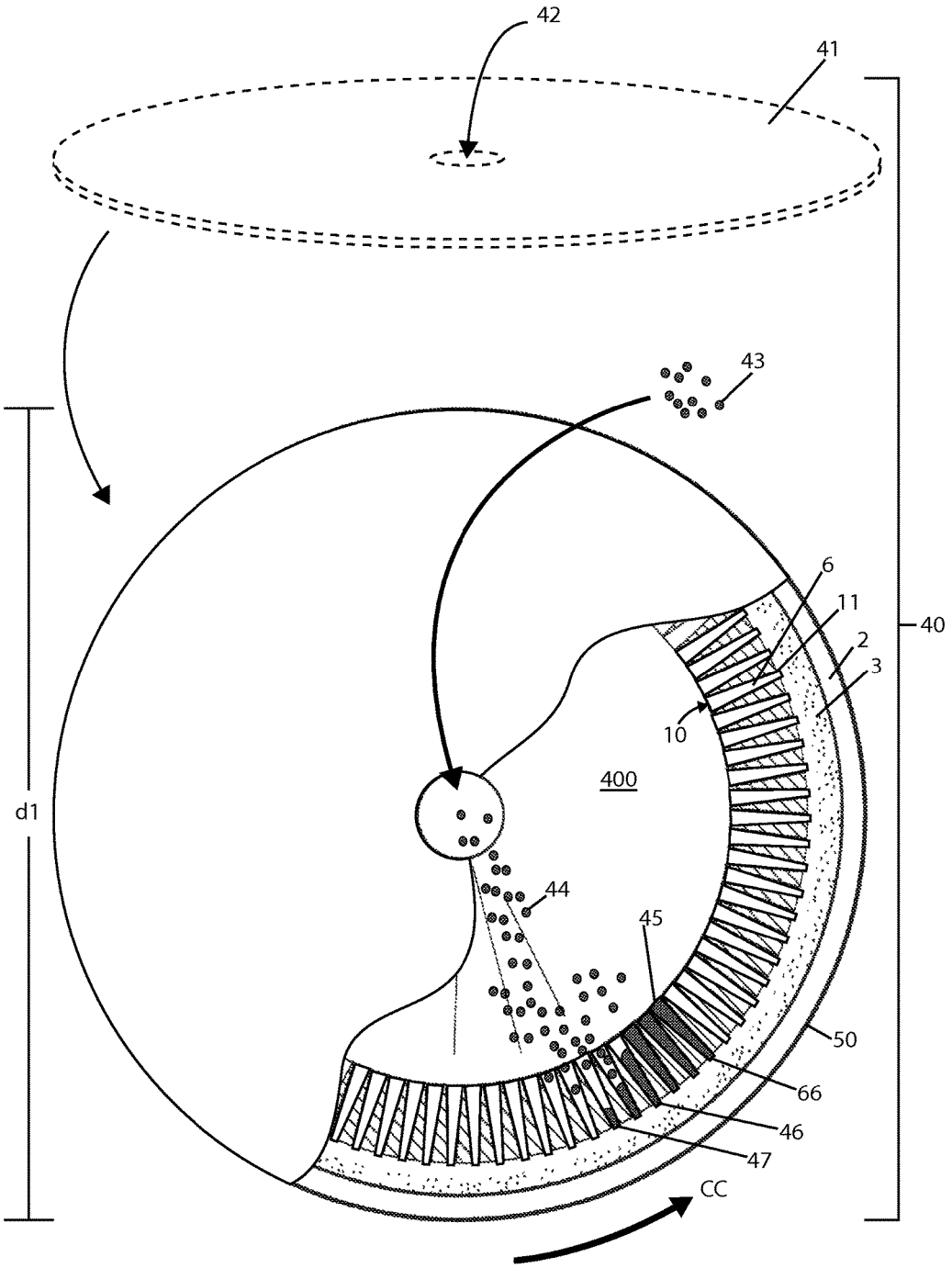
FIG. 4 is a top plan view with a cutaway of the lid on a rotatable platform.
Figure 5:
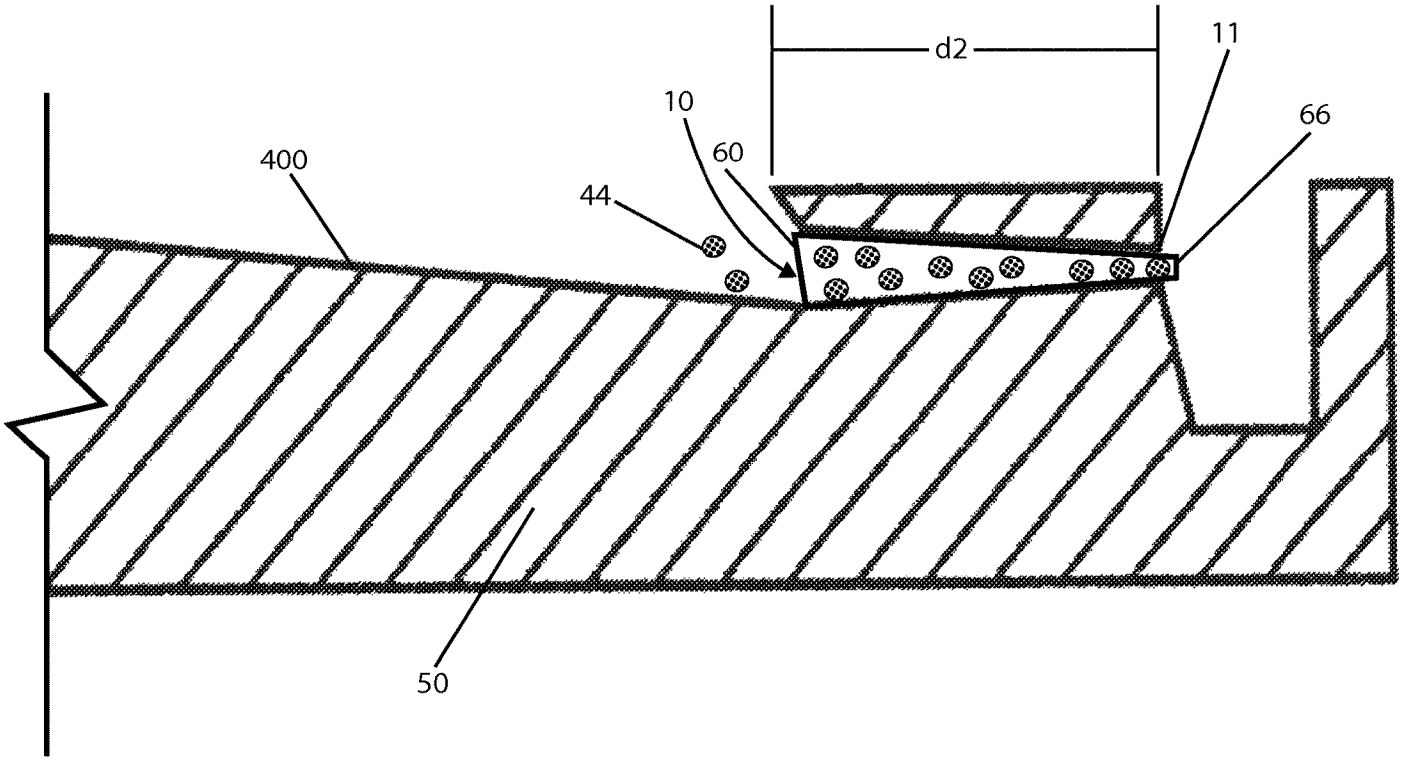
FIG. 5 is a close up view of a wrapper in a wrapper channel.
Figure 6:
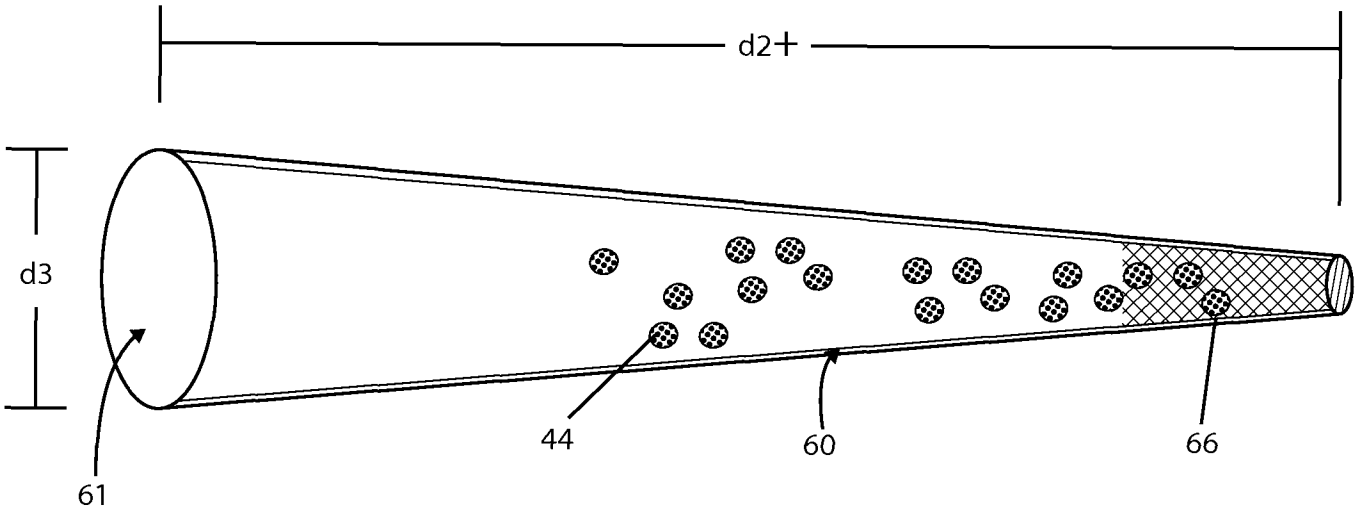
FIG. 6 is a side elevation view of a cigarette wrapper.

In one embodiment, the containment feature 2, passive in use, is comprised of a containment feature integrated into the rotational platform so as to rotate with said platform. This containment feature 2 provides a functional barrier for filler material that captures errant particles, which may traverse thru the recesses 6 when empty or pass through the pre-formed cigarette wrappers. This containment feature 2 (a peripheral wall) is typically at least as tall as the perimeter boundary and is placed between said perimeter boundary and the outer perimeter of the rotational platform forming the catch basin 3. FIG. 4 shows the dispersing area 400. FIG. 2B shows an axle mount hole 7.

In alternate embodiments, the containment feature may exhibit a top cap extending back toward the central axis of the rotational platform. This top cap provides not only more particle retention, but also enables the constraint of an additional filler material retention cap to extending from the containment feature and the perimeter boundary.

In the preferred embodiment, the containment feature stands at the circumference of the rotational platform at least as tall as the perimeter boundary to enable the capture of particles that would otherwise be ejected and wasted.

In other embodiments the passive containment mechanism provides a centralized point, which all the captured errant particles of filler material are congregated for convenient removal and reintroduction into the filling process.

In an alternative embodiment of the apparatus, a containment mechanism, active in use, is comprised of a method using an air-pressure differential to provide a vacuum to a boundary perimeter outside the rotational platform bounds to capture the errant filler particles and optionally collects said errant particles in one central location for easy removal and reuse in the filling process.

The preferred embodiment of the invention comprises a planar rotational platform with recesses 6, an electrically actuated motor, a containment feature 2 and braking mechanism. The planar rotational platform, substantially circular and constructed of plastic of at least 0.25" in thickness, exhibits a substantially flat form. On this platform, an integrated perimeter boundary sits raised from the platform bed with a plurality of equally spaced rectangular recesses with minimized wall space normal to a radial line to minimize ineffective area. Furthermore, these rectangular recesses 10 transition to a conical or cylindrical form to enable to uniform constraint of inserted pre-rolled cigarette wrappers. The electrically actuated motor is coupled to the rotational platform to provide rotational motion to the rotational platform. Furthermore the containment feature is constructed of a clear plastic and is affixed to the apparatus on the outer circumference of the rotational platform. Still within the preferred embodiment, the braking mechanism exists frictional brake acting upon the underside of the rotational platform near the circumference to enable a controlled and safe arrest of the rotational platform. In use, the user inserts the desired number of pre-rolled cigarette wrappers into the recesses which are sized such that they sit flush of the interior face of the perimeter boundary and proud of the exterior face of the perimeter boundary when inserted. If all the recesses are not utilized, it is preferred that the user spaces the wrappers equally to ensure a balanced operation of the rotational platform. The user then prepares the appropriate amount of filler material for desired particulate size and amount based upon factors such as filler material, preferred fill-density and preferred burn-rate. When prepared, the user places the containment mechanism over the rotational platform and actuates the electrical motor to drive the rotational platform to a predetermined rotational speed. At this point, through the aperture in the containment mechanism the user gradually deposits the prepared filler material and allows the apparatus to spin until the desired fill is achieved. When the desired fill is achieved, the user applies the brake mechanism to slow the rotational platform to a complete stop at which point the user can remove the containment mechanism and remove the filled wrappers.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. The descriptive labels associated with the numerical references in the figures are intended to merely illustrate embodiments of the invention, and are in no way intended to limit the invention to the scope of the descriptive labels.

The benefits, advantages, solutions to problems, and any elements(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms “comprises,” “comprising,” “has,” “having,”

"includes," "including," "contains," "containing," or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about," or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The terms "coupled" and "linked" as used herein is defined as connected, although not necessarily directly and not necessarily mechanically. A device or structure that is "configured" in a certain way is configured in at least that way, but may also be configured in ways that are not listed. Also, the sequence of steps in a flow diagram or elements in the claims, even when preceded by a letter does not imply or require that sequence.

Referring next to FIGS. 4, 5, 6, 7 a circular platform 50 may be housed in a frame 78 which secures an axle 77 to the circular platform 50. A motor M has a drive pulley (not shown) that drives a belt 75 and pulley 76. A lid detector 79 shuts off the motor M if the lid 41 is not mounted on the circular platform 50.

A wrapper housing 71 can have nominally 88 entry ports 10. The exit port is labeled 11. A crutch (closed end) 66 of wrapper 60 extends out the exit port 11 during the load (spinning) cycle so as to allow the user to push the wrapper 60 out the entry port 10 to harvest the filled wrappers. Nominal dimensions are d1=24", d2=3 ⅝", entry port when it becomes conical is 10=⅜"; the square entry port is slightly larger 11=3/16" diameter.

Figure 7:
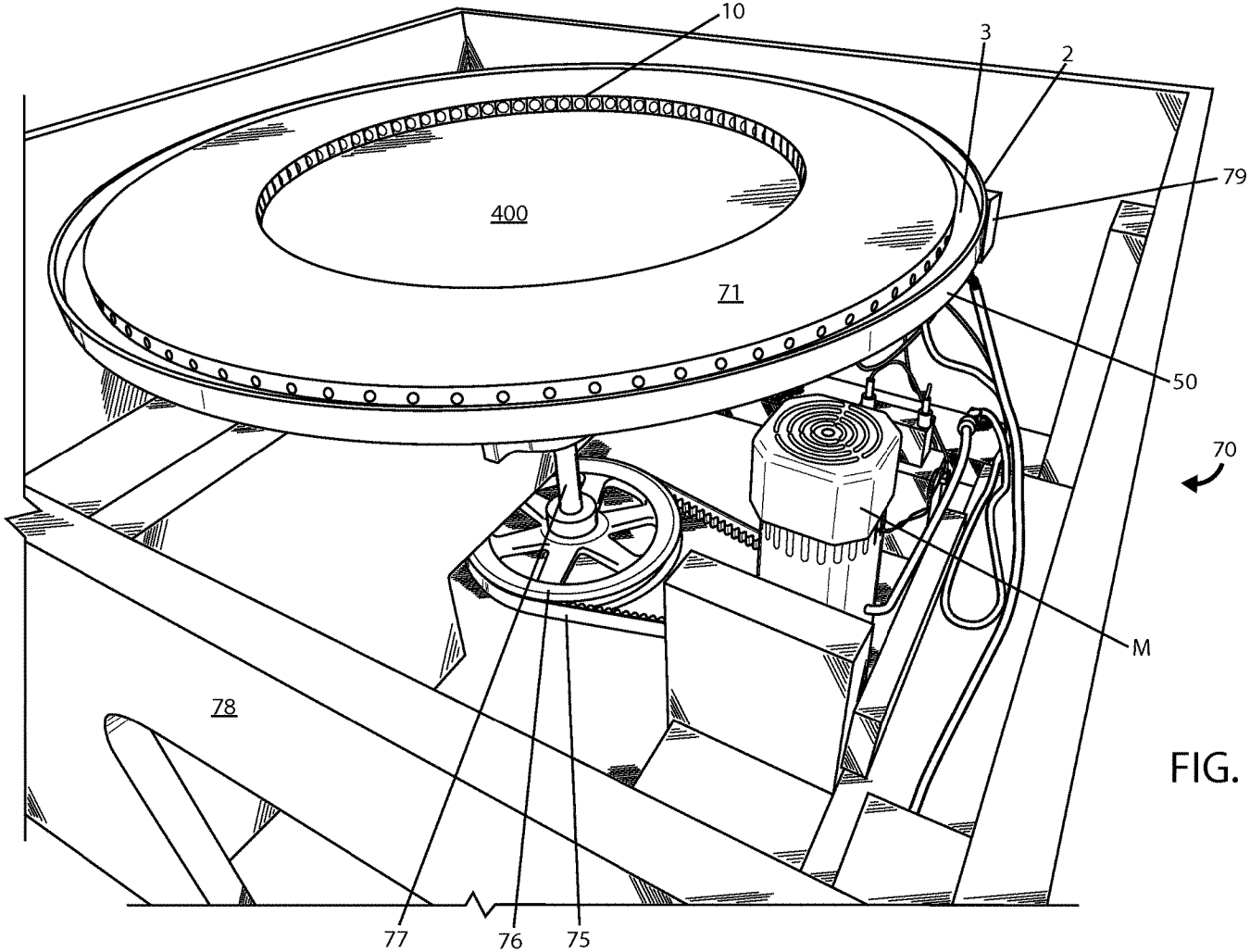
FIG. 7 is a top perspective view of an electrically powered filler machine.

In operation the user puts the lid 41 on the platform 50 and starts motor M. If each cigarette uses one gram, the user pours 88 grams (labeled 43) (for a fully loaded wrapper housing 70) into the fill hole 42 of lid 41. The dispersing area 400 catches work material now labeled 44 which has filled wrappers 45, and partially filled wrappers 46, 47 with platform 50 rotating counter-clockwise as shown by arrow CC. The system in FIG. 4 is labeled 40. The system in FIG. 7 is labeled 70. The wrapper 60 has a standard closed end 66 called a crutch. The open (fill) end is labeled 61. The dimension d3 is about 5/16".

I claim:

1. A cigarette filling machine comprising:

a rotatable platform with a rotational axis at its center of mass;

a rotation means functioning to rotate the rotatable platform;

a peripheral raised perimeter housing offset a distance from the rotational axis so as to form a dispersing area between the rotational axis and an inward facing circular wall of the raised perimeter housing;

said inward facing circular wall comprising a plurality of adjacent square entry ports sized to receive a rolled up cigarette paper;

each square entry port having a tapered receiving channel to hold the rolled up cigarette paper during a load cycle;

each tapered receiving channel having an exit port at an outer boundary wall of the raised perimeter housing;

wherein the rolled up cigarette paper extends outboard from the exit port during the load cycle;

an outer retaining wall located along a perimeter of the rotatable platform forming a catch basin between itself and the outer boundary wall;

a removable lid sized to cover the rotatable platform and rest upon a flat surface of the raised perimeter housing, thereby preventing any excess work material from escaping over the raised perimeter housing;

a brake means functions to stop a rotation of the rotatable platform;

wherein inserting a rolled up cigarette paper in each square entry port and placing a work material in the dispensing area and rotating the rotatable platform packages the work material into the rolled up cigarette papers; and wherein any excess work material is captured in the catch basin.

2. The machine of claim 1, wherein the removable lid further comprises a central fill hole for the work material.

3. The machine of claim 1, wherein the rolled up cigarette paper has a closed end that fits into the exit port and extends beyond the exit port during the load cycle, thereby providing a rod to push to remove the rolled up cigarette paper with the work material loaded onto it.

4. The material of claim 1, wherein the rotation means is an electric motor.

5. The machine of claim 4, wherein the brake means further comprises a retractable brake pad contacting a bottom surface of the rotatable platform.

6. The machine of claim 1, wherein the rotatable platform has a diameter of about 24" and the plurality of adjacent square entry ports number 88.

7. The machine of claim 4, wherein the electric motor is housed in a case and drives the rotatable platform via a pulley linkage to an axle supporting the rotatable platform.

8. The machine of claim 7, wherein the motor has a braking circuit means functioning to stop the rotatable platform after the load cycle.

9. The machine of claim 1, wherein each square entry port has a side measuring about ⅜".

10. The machine of claim 9, wherein a length of the tapered receiving channel measures about 3 ⅝".

11. The machine of claim 4, wherein the rotatable platform has a lid detector means functioning to turn off the electric motor when the lid is not mounted on the rotatable platform.

* * * * *